United States Patent [19]

Asai et al.

[11] 4,016,011

[45] Apr. 5, 1977

[54] METHOD FOR HEAT TREATMENT OF HIGH ALLOY STEEL IN A NONEXPLOSIVE ATMOSPHERE

[75] Inventors: Takeji Asai; Kaishu Yamazumi, both of Toyama, Japan

[73] Assignee: Kabushiki Kaisha Fujikoshi, Japan

[22] Filed: Sept. 10, 1975

[21] Appl. No.: 612,222

[30] Foreign Application Priority Data

Apr. 2, 1975 Japan ..... 50-40520

[52] U.S. Cl. ..... 148/16; 148/20.3

[51] Int. Cl.[2] ..... C21D 1/48

[58] Field of Search ..... 148/16, 16.5, 12.1, 148/20.3; 266/5 R

[56] References Cited

UNITED STATES PATENTS

| | | | |
|---|---|---|---|
| 3,127,289 | 3/1964 | Beall | 148/16 |
| 3,188,246 | 6/1965 | Olt et al. | 148/16 |
| 3,201,290 | 8/1965 | Wyss | 148/16.5 |
| 3,356,541 | 12/1967 | Cullen | 148/16.5 |
| 3,397,875 | 8/1968 | Davis | 148/16.5 |
| 3,413,161 | 11/1968 | Goehring | 148/16.5 |
| 3,725,141 | 4/1973 | Hill | 148/16 |

*Primary Examiner*—Walter R. Satterfield
*Attorney, Agent, or Firm*—Spensley, Horn & Lubitz

[57] ABSTRACT

The method of this invention is directed to the heat treatment of an iron-containing article and comprises the steps of subjecting the article to an atmosphere comprising specific amounts of nitrogen, carbon, hydrogen, and carbon monoxide and heating this article in this atmosphere. The furnace comprises first and second interconnected chambers, with the first chamber being a heating chamber and the second chamber being a cooling chamber. The first chamber is selectively joined to the second chamber by a gate means. The heating chamber has a heating plate disposed therein arranged and configured to support an article thereon. The heating chamber further has heating means for heating the chamber disposed therein. The cooling chamber has means for positioning the article therein and at least one nozzle for selectively introducing nitrogen gas into the cooling chamber. The furnace also has a gas port extending through the heating chamber which is arranged and configured such that when a gas proceeds therethrough, gas impinges on the heating plate at a predetermined angle. By the use of the furnace and specific atmosphere, iron-containing articles, such as, for example, steel and the like, can be treated to improve their surface characteristics.

5 Claims, 5 Drawing Figures

METHOD FOR HEAT TREATMENT OF HIGH ALLOY STEEL IN A NONEXPLOSIVE ATMOSPHERE

BACKGROUND OF THE INVENTION

1. Field of the Invention

This invention relates to a method and apparatus used for heat treatment of steel.

2. Prior Art

This invention is an improvement of the applicant's patent application filed in Japan, No. 47-8916, entitled "Heat Treatment Method for High Alloy Steel" and Japanese application No. 47-45776, entitled "Hardening Process for High Alloy Steels". In patent application No. 47-8916, the gas constituents are limited to the following: carbon monoxide 0.2 to 1.0%, hydrogen 0.5 to 2.0%, the remainder being nitrogen gas. All percentages per volume percent. In cases where a steel or an iron article containing large quantities of oxide is heated in a process wherein simultaneous heat-hardening and soldering takes place, the reducing power of the above-identified gas constitutes the atmosphere of the furnace and has been found to be insufficient to produce the desired surface characteristics. This has lead to poor results when such articles are soldered together. This invention, and more specifically, the atmosphere specifically set forth herein, permits simultaneous soldering and heat-hardening of iron and steel even those articles with an outside coating adhering thereto by the use of an atmosphere containing 0.5 to 1.5% carbon monoxide, 0.5 to 2.5% hydrogen, and the remainder of the atmosphere containing nitrogen with a minute amount of activated carbon therein, again, all percentages being volume percent.

Patent application No. 47-45776 is concerned with atmospheric cooling as is the present application. In that application the method to cool the article involved the consumption of large quantities of nitrogen gas. This represents an economic problem as such cooling process is relatively expensive and time consuming. This invention further includes a process whereby the atmospheric gas of the furnace is passed through a heat exchanger which thereby cools it and returns the gas to the furnace, which gas as described hereinabove is almost completely nitrogen. The gas is then reused as a quenching gas.

The present invention, therefore, is directed to a method and apparatus which are further improvements in the art of heat treatment of iron and steel articles.

SUMMARY OF THE INVENTION

This invention is concerned with the formation of a specific atmospheric gas which contains a plurality of different gases and activated carbon, which atmosphere is used for the hardening and soldering treatment of high alloy steels such as die steel and high speed steel, and for the brightness heat treatment of stainless steel, as well as that treatment method and equipment used therein. In the method of this invention, a completely neutral protective gas atmosphere or a weakly reducing atmosphere is formed by using a noncombustible, nonexplosive protective gas made by adding a minute quantity of a liquid organic compound, which forms a reducing gas, to a nitrogen gas (the main component of the atmosphere) and subjecting the liquid organic compound to thermal cracking in the nitrogen. The resulting gas which is formed is then used as the heat treatment atmosphere for the iron-containing article.

It is known in the art that when using an atmosphere comprising solely nitrogen gas, it is difficult to preserve a generally high-purity nitrogen atmosphere because of contamination in the furnace from influences of minute quantities of oxidate gas contained in the nitrogen gas. This is further complicated by the fact that oxidizing substances adhere to the heated object or forged tool and that air and moisture that penetrate the furnace when the cover is opened and closed further introduce contaminants into the nitrogen gas atmosphere.

In order to achieve a nitrogen gas atmosphere of the requisite high purity, the present invention prescribed to the addition to the nitrogen gas of a controlled amount of a liquid organic compound. The liquid organic compound tends to create a reducing gas and is forced to undergo thermal cracking in the nitrogen gas. The resulting atmosphere gas is formed which contains carbon monoxide hydrogen within predetermined limits, the remainder being nitrogen gas. Within this protected gas atmosphere, it is possible to maintain a neutral atmosphere completely without the oxidation, decarburization, or carburization caused during the heating of the iron and/or steel article.

The novel features which are believed to be characteristic of the invention, both as to its organization and methods of operation, together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limits of the invention.

Figure 1:
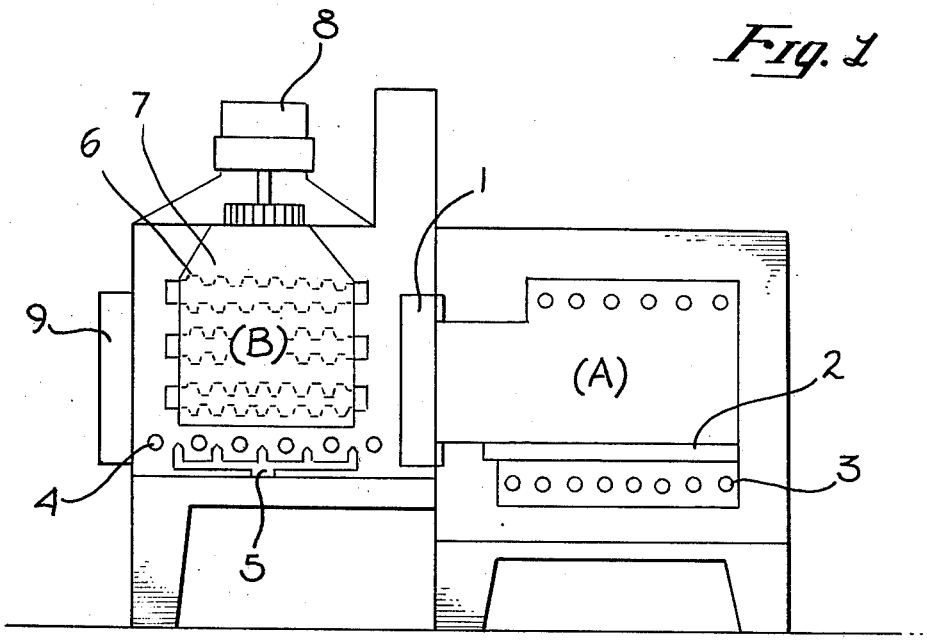
FIG. 1 is a cross-sectional sketch of the high temperature atmospheric heat-hardening furnace of the instant invention.

DESCRIPTION OF THE PREFERRED EMBODIMENT:

Broadly, this invention involves a method for the heat treatment of iron-containing articles using a non-explosive atmosphere of certain constituents. In the preferred method of this invention, a minute quantity of an organic liquid is added to a nitrogen gas. The liquid organic compound is then directly subjected to thermal cracking in a heat furnace. This produces a non-explosive neutral or weak reducing atmosphere which comprises from about 0.5 to 1.5% carbon monoxide by volume, 0.5 to 2.5% hydrogen by volume, and a minute but predetermined quantity of activated carbon with the remainder being nitrogen. It is in this unique atmosphere that the heating of the iron-containing article takes place. In improvement to the above-referenced method, the extra gas from such method may be cooled and then used as the cooling gas for the iron-containing article.

An example of thermal cracking of the liquid organic compound is shown below. For instance, isopropyl alcohol ($(CH_3)_2CHOH$) and methyl acetate ($CH_3COOCH_3$) theoretically undergo complete thermal cracking as below; carbon monoxide and hydrogen are formed and the excess carbon separates out.

$$(CH_3)_2CHOH \rightarrow 2(C) + CO + 4H_2 \quad (1)$$

$$CH_3COOHCH_3 \rightarrow (C) + 2CO + 3H_2 \quad (2)$$

The carbon monoxide and hydrogen produced react at high temperature with any oxidate gas contained in the nitrogen gas or with the oxidizing substances existing in the furnace that adhere to and permeate the product. The reactions with the oxidate gas and/or the oxidizing substances act so as to prevent the oxidation and decarburization of the work piece which would otherwise occur.

Thus, if oxidizing substances are present, these reducing gases produced by thermal cracking the organic compound, react with them and become the main causal factor in the rise of the dewpoint and the formation of new oxidate gases. Consequently, when large quantities of oxidizing substances are present in the furnace the addition only of small quantities of reducing gases in unsatisfactory. It is necessary both to eliminate the newly formed oxidate gases and to lower the dew point. To that end the excess carbon in the final atmosphere is effective in that it simultaneously forms reducing gases and reacts with the oxidizing substances to produce reducing gases.

With regard to the aforementioned gas reactions, we illustrate an example with the following chemical equations. Oxidate gases, for instances oxygen and water vapor, react with the reducing gases to produce new oxidate gases.

$$CO + 1/2O_2 \rightarrow CO_2 \quad (3)$$

$$H_2 + 1/2\,O_2 \rightarrow H_2O \quad (4)$$

Moreover, they react with oxidizing substances such as iron oxide scale and form oxidate gases as per equations (3) and (4).

$$3CO + Fe_2O_3 \rightarrow 2Fe + 3CO_2 \quad (5)$$

$$3H_2 + Fe_2O_3 \rightarrow 2Fe + 3H_2O \quad (6)$$

As for the carbon dioxide and water vapor produced from the reactions of equations (3) to (6), when the quantity of these produced becomes large, they react with the heated object and act to promote the undesired oxidizing and decarburizing reactions. The excess activated carbon produced by the thermal cracking of the liquid organic compound reacts directly at a high temperature with oxidate gases formed per equations (3) to (6) or with the oxidate gases present in the furnace. A reducing gas is produced as shown in the following chemical equations.

$$CO_2 + C \rightarrow 2\,CO \quad (7)$$

$$H_2O + C \rightarrow H_2 + CO \quad (8)$$

Equations (9) and (10) clarify the reaction of the activated carbon formed by the thermal cracking of the liquid organic compound with the oxidate gas in the furnace and the formation of the reducing gas.

$$98N_2 + 0.6(CH_3)_2CHOH \rightarrow 98N_2 + 0.6CO + 2.4H_2 + 1.2C \quad (9)$$

$$98N_2 + 0.6(CH_3)_2CHOH + 0.80_2 \rightarrow 98N_2 + 1.5CO + 2.3H_2 + 0.3CO_2 + 0.1H_2O \quad (10)$$

Formula (9) shows the theoretical thermal cracking at a high temperature of 1200° C of a mixed gas made by the addition of 0.6 mole of isopropyl alcohol to 98 moles of nitrogen gas. It shows that 97.03% nitrogen, 0.59% carbon monoxide, 2.38% hydrogen, and 1.2% of activated carbon are the result, all percentages being volume percent.

Formula (10) is a chemical formula that shows the analysis value of the gas formed under conditions where 0.8 mole of oxygen is added to the mixed gas of formula (9) above. The added oxygen reacts with the activated carbon, and a neutral gas atmosphere consisting of 95.89% nitrogen, 1.47% carbon monoxide, 2.25% hydrogen, 0.29% carbon dioxide, and 0.1% water vapor is formed.

As explained above, the minute quantity of liquid organic compound added to the nitrogen gas undergoes thermal cracking in a high temperature furnace and reacts with the oxidate gas or oxidizing substances which are the main cause of undesired oxidation and decarburization of the iron-containing article. By reducing these gases, a neutral atmosphere is formed. Thus it becomes possible to form a protective atmosphere of a gas composition that is most appropriate for the heated object, by means of suitable controlling the quantity of liquid organic compound added.

In our research it has been ascertained that a liquid organic compound containing oxygen is effective and that the amount of activated carbon produced is the most suitable parameter for expressing the reducing power in terms of the ratio (C/O) of the carbon to the oxygen contained in the liquid organic compound. Furthermore, the production of soot is likely when a liquid organic compound or a hydrocarbon that does not contain oxygen undergoes thermal cracking in a high temperature furnace, making these substances unsatisfactory as additives.

In addition, we performed an investigation of the gas composition and the oxidation and decarburization phenomena at each temperature with respect to each king of high alloy steel. The observed results were as follows:

The atmosphere gas produced by the addition of a minute quantity of hydrogen gas — outside the lower explosive limit — to nitrogen gas reacted with oxygen or oxidizing substances in a furnace at a high temperature of 1200° C to form water vapor. A sudden rise in the dewpoint was observed. As a result, the decarburizing phenomenon was marked in the heated object. The atmosphere gas produced by adding a gas mixture of hydrogen and carbon monoxide — outside the lower explosive limit — gave rise to carbon dioxide and water vapor. The rise is dewpoint was insignificant and the extent of the decarburizing phenomenon was extremely minute. It is clear from these phenomena that, in the capacity of a non-explosive gas having nitrogen as its main component, which is outside the lower explosive limit, a gas atmosphere that contains carbon monoxide is more effective.

Two or three operational examples are described below in which the atmosphere stipulated by this invention is used.

It has been ascertained that the most satisfactory results can be achieved for die steel heat-hardened at 1000° C to 1050° C with 0.7 to 1.2% carbon monoxide and 1.0 to 1.8% hydrogen; and for high speed steel heat-hardened at a high temperature of 1200° C and up, with 1.0 to 1.2% carbon monoxide and 2% hydrogen. Furthermore, a stable protective atmosphere cannot be maintained if we do not add a reducing gas plus a quantity of activated carbon accompanying the rise in heating temperature.

Perfect soldering without flux is also possible in a simultaneous soldering-hardening process in which high speed steel is soldered to a carbon steel base, when the atmosphere gas containing a minute quantity of activated carbon is suitable as regards carbon monoxide at 1.0 to 1.5% and hydrogen at 2.0 to 2.5%. Again, when stainless steel is heated, an atmosphere gas with a small quantity of reducing gas on the order of 0.5 to 0.8% by volume carbon monoxide and 0.5 to 1.0% by volume hydrogen is effective, and bright surface hardening is possible. These minute quantities of reducing gases, contained in an atmosphere gas that has nitrogen as its major component, are extremely slow in the decarburization and carburization reactions, and our research has confirmed that the atmosphere displays a neutral nature.

From the above research results, the following points have become clear: the heat treating atmosphere that best suits the different kinds of high alloy steel at high temperatures of 900° C and above contains a reducing gas with 0.5 to 1.5% carbon monoxide and 0.5 to 2.5% hydrogen, the remainder being nitrogen; an atmosphere containing a minute quantity of activated carbon in addition to this is most satisfactory.

The second characteristic of this invention concerns a method of cooling after heat hardening. In general, as for high speed die steels, common hardening methods following heating are hot bath quenching, oil quenching, and air cooling. The cooling effect of oil quenching is superior to that of air cooling, but oil vapor, oil soot, and the gases from decomposition of the oil produced in oil quenching contaminate the cooling chamber and even penetrate the heating chamber to disturb the atmosphere. Again, with high alloy tool steel, there is the danger of the formation of heat cracks from oil quenching; also deformation and strain are considerable after the treatment. Moreover, since the oil vapor, oil soot, and harmful gases which are produced escape from the cooling chamber, the working environmental deteriorates the elimination of the oil that adheres to the product, as well as many other problem points, cannot be ignored. This invention has solved the above-mentioned problems by substituting gas cooling for oil quenching.

Some operational examples are explained below.

The high temperature heat hardening furnace shown in FIG. 1 consists of a heating chamber A and a cooling chamber B. These two chambers are connected through the heating chamber door 1 and are completely cut off from any outside air. A constant pressure is maintained to guard against the air penetration. The heating chamber has a silicon carbide hearth plate 2 and heating elements 3 and is constructed of insulating fire brick. The periphery of the side surface of the furnace body functions as the structure that supplies the atmosphere gas, as stated below.

The lower section of the cooling chamber B is equipped with rollers 4 for shifting the basket and jet nozzles for liquid nitrogen. On the side surfaces are heat exchangers 6 and blow control plates 7; a cooling fan 8 for circulating the cooling gas is installed in the upper section. 9 is a door that excludes the outside air. The atmosphere gas from the heating chamber is exhausted into the cooling chamber through the connecting doorway. It passes through and is cooled by the heat exchangers installed in both lateral surfaces of the cooling chamber, and is made to circulate and serve as a cooling gas for the heated object. When cooling power is to be increased further, liquid nitrogen is jetted up from the bottom section of the cooling chamber and adds effectiveness to the aforementioned techniques.

Figure 2:
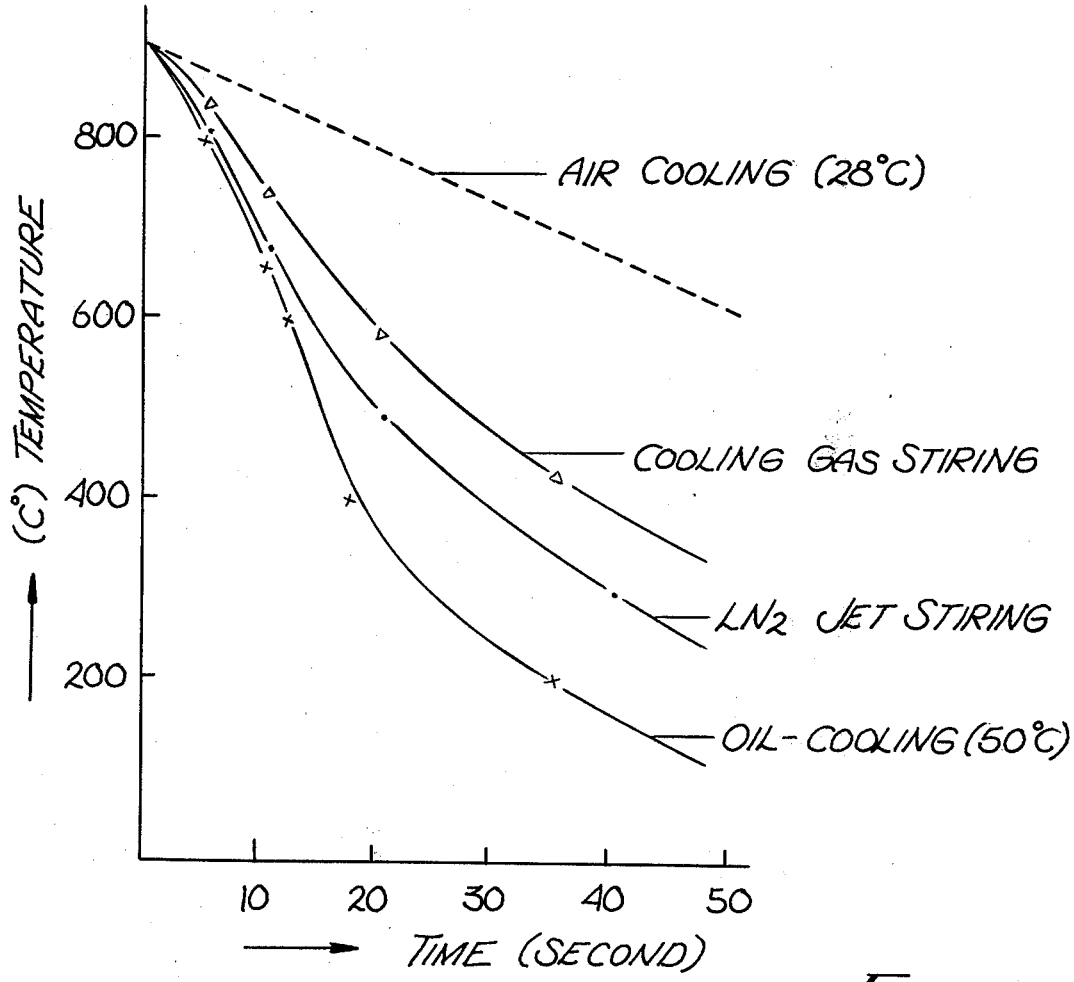
FIG. 2 is a draft which compares the cooling curves for various types of cooling techniques.
Figure 3:
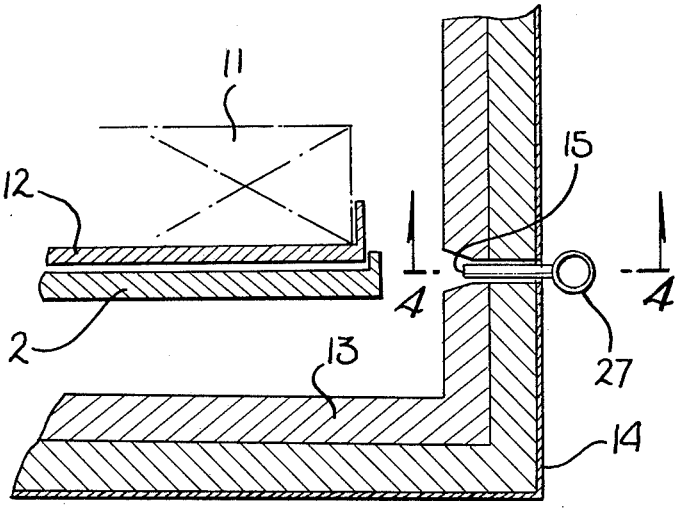
FIG. 3 is an enlarged cross-sectional view of FIG. 1 showing a portion of the heating furnace wall.
Figure 4:
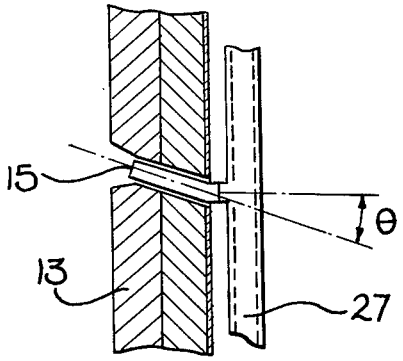
FIG. 4 is a partial horizontal cross-sectional view taken along lines 44 of FIG. 3 in showing how a gas nozzle is mounted in the furnace wall.
Figure 5:
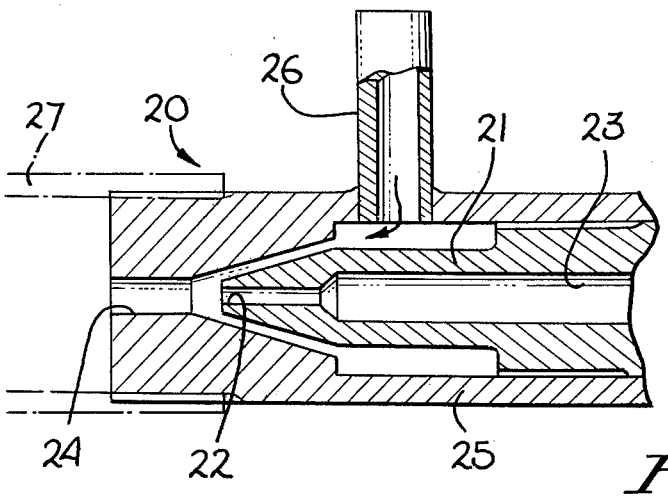
FIG. 5 is a sectional view of the gas mixer shown in FIG. 3 as element 27.

FIG. 2 shows the cooling curve for each type of cooling method. Since a higher degree of interfacial thermal conductivity is attainable with agitation cooling by forced circulation of coolant gas than with air cooling, the cooling speed is increased; moreover, when it is used in combination with jets of liquid nitrogen, a cooling effect approximating that of oil cooling is attained. This enables heat-hardening or simultaneous soldering and heat-hardening of high alloy tool steel, such as thick die steels and high-speed steels, and bright-surface treatment of stainless steel.

An improved aspect of the furnace of this invention concerns the disposition of the source gas supply ports in the furnace and a transfer method for the source gas. In general, atmosphere heating furnaces have used agitating fans for the purpose of homogenizing the atmosphere and temperature distribution inside the furnace. However, at high temperatures of 1200° C and above, the installation of agitating fans poses some extremely difficult problems having to do with the material and life expectancy of the fans. In order to devise a solution to the problem of agitation, we performed research on the disposition, type, and angle of the source gas supply ports.

The position and angle of the source gas supply ports dispose along the furnace walls are shown in detail in diagrams 3 and 4. 11 is the basket used in treatment of the product 12 is the tray for shifting the basket; 2 is the aforementioned furnace hearth plate for treating the product; 13 is the fire-resistant insulation material used to contain the atmosphere; 14 is the furnace casing; 15 is a source gas supply port.

The source gas supply port 15 has a heat-resistant steel pipe that leads almost to the inner fire-resistant insulating wall surface of the heating chamber. The source gas flowing out of the supply port is made to collide with the edge of the furnace hearth plate in a horizontal direction at a fixed angle ($\theta = 10°–45°$) relative to a straight line perpendicular to the wall surface. Preheating of the source gas and thermal cracking of the liquid organic compound contained in the source gas are thus expedited and convection is facilitated in the atmosphere gas.

As for these source gas supply ports 15, two or more are situated in each of the opposite furnace walls and are installed so that the mouths of the source gas supply ports in opposite walls at the same horizontal cross-section face left and right in reverse directions. Consequently, the source gas, which has nitrogen gas as its main constituent, is led into the furnace through a supply port made of heat resistant steel pipe, impinges at a fixed angle on the edge of the furnace hearth plate that has been heated to a high temperature, and is thus preheated. At the same time, the liquid organic compound undergoes thermal cracking and the prescribed protective atmosphere gas is formed. This atmosphere gas moves in accordance with the direction of the supply ports, which have been installed at a definite angle. Since the angles of the supply ports installed in opposite walls are left and right opposite, a rotational motion is imparted to the transfer of the atmosphere gas. Preheating and agitation occur simultaneously and convection facilitated.

In our operational examples, the temperature distribution with respect to the prescribed temperature was −4° C in the vicinity of the tray 12 on top of the furnace hearth plate and ±2° C within the product treatment basket 11. Also there were no detectible differences in the atmosphere gas composition in the central part of the furnace that heats the product; it is clear that the temperature distribution and homogenizing of the atmosphere gas were extremely good.

A transfer method for the source gas will now be discussed. In general, nitrogen is moved forcefully by means of its own gas pressure; with liquids, the method used is to force-move them independently by means of pumps, using separate pipes. With such a method, there are problems encountered in homogeneously mixing the major-component nitrogen and the liquid organic compound, the position of the supply ports, and the homogeneity of the atmosphere gas, and satisfactory results are not to be expected. This invention utilizes a special mixer to solve these problems, and introduces a system wherein the discharge pressure of the nitrogen gas applies a suction to the liquid organic compound; the gas-vapor mixture thus produced is conveyed into the furnace.

As for the mixture 20, as shown in diagram No. 5, the nitrogen gas flow pipe 23 is equipped with a jet orifice 22 at the tip of an extremely fine nozzle 21. This pipe is screwed or otherwise suitable fastened into a mixing pipe 25 that has a mixing chamber 24 in close proximity to the jet orifice 22. The supply pipe 26 for the liquid organic compound is plugged into the mixing pipe 25 and opens toward the side wall of the nitrogen gas flow pipe nozzle 23. The liquid passes out through the periphery of the gas jet orifice 22 of the nozzle. This mixer is connected to a liquid-vapor gas mixture supply pipe 27, which passes through a source gas supply port 15 of the heating chamber. Nitrogen gas at a predetermined static pressure of four atmospheres or more flows out at high velocity through a nozzle 21 installed in the tip of the outflow pipe 23, having an extremely narrow flow path. Since the pressure drops at the periphery of the jet orifice 22 in the tip of the nozzle due to the high-velocity outflow of this nitrogen gas, the liquid organic compound from the supply pipe 26 is sucked out, mixed, and vaporized in the mixing pipe 25. The inside diameters of the nitrogen outflow nozzle tip 21 and the mixing pipe are determined according to the volume of the furnace and the quantity of gas flow. Some advantages arising from this arrangement are that a liquid transfer pump is unnecessary and there is no pulse flow.

Since the liquid organic compound is added in a minute quantity (below the vapor pressure of the compound in nitrogen gas at normal temperature), it vaporizes at the same time that mixing takes place. Consequently, the transfer of the vapor-liquid gas mixture is greatly facilitated; homogenous mixing along with long-distance transfer and supply to the furnace are possible.

While the invention has been described in its preferred embodiments, it is to be understood that the words which have been used are words of description rather than of limitation and that changes within the preview of the intended claims may be made without departure from the true scope and spirit of the invention in its broader aspects.

We claim:

1. A high temperature method for heat treatment of a high alloy steel article comprising the steps of:

mixing nitrogen gas with a liquid organic compound having at least one oxygen atom;

heating the mixture until said liquid organic compound is caused to crack whereby a nonexplosive, neutral or weak reducing atmosphere of 0.5 to 1.5 percent carbon monoxide by volume, 0.5 to 2.5 percent hydrogen by volume, a minute quantity of activated carbon and the remainder being nitrogen is created;

subjecting said article to said atmosphere; and heating said article to a high temperature in said atmosphere.

2. The high temperature method for heat treatment of a high alloy steel article according to claim 1 further comprising the step of cooling said iron containing article in said atmosphere.

3. The high temperature method of heat treatment of a high alloy steel article according to claim 1 further comprising the ordered steps of:

removing said atmosphere from about said article;

cooling said removed atmosphere;

recycling said cooled, removed atmosphere; and cooling said article with said recycled cooled atmosphere.

4. The high temperature method for heat treatment of a high alloy steel article according to claim 1 wherein said organic compound is selected from the group consisting of alcohols and acetates.

5. The high temperature method for heat treatment of a high alloy steel article according to claim 3 further comprising the step of injecting liquid nitrogen to cool said article quickly.

* * * * *